United States Patent [19]

Dorer, Jr.

[11] Patent Number: 4,505,718

[45] Date of Patent: Mar. 19, 1985

[54] ORGANO TRANSITION METAL SALT/ASHLESS DETERGENT-DISPERSANT COMBINATIONS

[75] Inventor: Casper J. Dorer, Jr., Lyndhurst, Ohio

[73] Assignee: The Lubrizol Corporation, Wickliffe, Ohio

[21] Appl. No.: 410,123

[22] Filed: Aug. 20, 1982

Related U.S. Application Data

[63] Continuation of Ser. No. 227,330, Jan. 22, 1981, abandoned.

[51] Int. Cl.[3] ..... C10L 1/22; C10L 1/30

[52] U.S. Cl. ..... 44/66; 44/68; 44/76

[58] Field of Search ..... 44/63, 66, 68, 76; 252/51.5 A, 33.4, 49.7

[56] References Cited

U.S. PATENT DOCUMENTS

| | | | |
|---|---|---|---|
| 2,402,448 | 6/1946 | Richards . | |
| 2,406,564 | 8/1946 | Rogers et al. . | |
| 2,575,003 | 11/1951 | Caron et al. . | |
| 2,579,890 | 12/1951 | Wies et al. . | |
| 2,684,292 | 7/1954 | Caron et al. . | |
| 2,695,910 | 11/1954 | Asseff et al. . | |
| 2,699,427 | 1/1955 | Smith et al. . | |
| 2,785,131 | 3/1957 | O'Connor . | |
| 2,914,417 | 11/1959 | Chamot et al. . | |
| 2,924,617 | 2/1960 | Wright . | |
| 2,924,618 | 2/1960 | Anderson et al. . | |
| 2,983,741 | 5/1961 | Brantley . | |
| 2,996,364 | 8/1961 | Gay et al. . | |
| 3,007,781 | 11/1961 | Billmeier et al. . | |
| 3,172,892 | 3/1965 | Le Seur et al. . | |
| 3,219,666 | 11/1965 | Norman et al. | 252/51.5 A |
| 3,240,575 | 3/1966 | Miller et al. . | |
| 3,264,075 | 8/1966 | Gee et al. . | |
| 3,271,310 | 9/1966 | Le Seur . | |
| 3,272,746 | 9/1966 | Le Seur et al. . | |
| 3,275,554 | 9/1966 | Wagenaar . | |
| 3,312,618 | 4/1967 | Le Seur . | |
| 3,348,932 | 10/1967 | Kukin . | |
| 3,355,270 | 11/1967 | Amick et al. . | |
| 3,405,064 | 10/1968 | Miller . | |
| 3,438,757 | 4/1969 | Honnen et al. . | |
| 3,443,916 | 5/1969 | Rolfe . | |
| 3,454,555 | 7/1969 | van der Voart et al. . | |
| 3,498,766 | 3/1970 | Gee et al. . | |
| 3,522,179 | 7/1970 | Le Seur . | |
| 3,565,804 | 2/1971 | Honnen et al. . | |
| 3,624,115 | 11/1971 | Otto . | |
| 3,642,847 | 2/1972 | Otto et al. . | |
| 3,649,659 | 3/1972 | Otto et al. . | |
| 3,649,661 | 3/1972 | Otto et al. . | |
| 3,674,450 | 7/1972 | Filachek et al. . | |
| 3,692,503 | 6/1972 | Kukin . | |
| 3,725,441 | 4/1973 | Murphy . | |
| 3,762,890 | 10/1973 | Collins . | |
| 3,806,456 | 4/1974 | Vogel | 44/66 |
| 3,827,979 | 8/1974 | Piotrowski et al. | 252/33 |
| 3,827,979 | 8/1974 | Piotrowski et al. . | |
| 3,941,606 | 3/1976 | Collins et al. . | |
| 4,035,309 | 7/1977 | Brois . | |
| 4,100,082 | 6/1978 | Clason et al. . | |
| 4,136,043 | 1/1979 | Davis . | |
| 4,155,718 | 5/1979 | Graiff . | |
| 4,162,986 | 7/1979 | Alkaitis et al. . | |
| 4,179,385 | 12/1979 | Ali et al. | 252/33 |
| 4,191,658 | 3/1980 | Jahnke . | |

FOREIGN PATENT DOCUMENTS

| | | |
|---|---|---|
| 2019877 | 5/1978 | United Kingdom . |

OTHER PUBLICATIONS

"Resumé of Additives for Diesel Fuels and Their Function" brochure based on presentation by Dr. C. O. Miller, Diesel Fuel Symposium, Detroit, Mich., 1970.

*Primary Examiner*—Jacqueline V. Howard

*Attorney, Agent, or Firm*—Raymond F. Keller; Denis A. Polyn; Walter C. Danison

[57] ABSTRACT

Compositions comprising the combination of a transition metal salt of an organic acid and an ashless hydrocarbon-soluble ashless dispersant are useful in treating lubricants and fuels. Typical compositions comprise manganese carboxylates and acylated nitrogen-containing dispersants.

11 Claims, No Drawings

ORGANO TRANSITION METAL SALT/ASHLESS DETERGENT-DISPERSANT COMBINATIONS

This is a continuation of application Ser. No. 227,330, filed Jan. 22, 1981, now abandoned.

BACKGROUND OF THE INVENTION

1. Field of the Invention

This invention relates to hydrocarbon-soluble compositions containing a transition metal salt of an organic acid and a hydrocarbon-soluble ashless dispersant. Typically, it relates to such compositions wherein the organic acid is a carboxylic, sulfonic or phosphorus acid and the ashless dispersant is a nitrogen or non-nitrogen containing ester dispersant. It also relates to hydrocarbon systems containing the aforesaid compositions, such as lubricants based on oils of lubricating viscosity and hydrocarbon fuels.

2. Prior Art

The treatment of hydrocarbon systems such as lubricants based on lubricating oils of lubricating viscosity (e.g., greases, lubricating oils and the like) and hydrocarbon fuels of both the solid and normally liquid type with transition metals and transition metal-containing compounds, both organic and inorganic, is well known to the art. Such treatments are used to increase the systems' resistance to oxidative deterioration, promote their conversion to cohesive films in the case of paints and lacquers, and improve their combustion as, for example, fuels.

Among the organic transition metal compounds that have been used for such purposes are carboxylate and sulfonate salts and mixtures of such salts. For example, U.S. Pat. No. 4,162,986 to Alkaitis et al. describes transition metal salts of mixed organic carboxylic and sulfonic or second carboxylic acids and their use as catalysts, anti-knock agents, combustion improvers, smoke suppressants, curing agents, driers, micronutrient sources, lubricant additives, and the like.

U.S. Pat. No. 3,762,890 to Collins describes hydrolyzable manganese soaps, stabilized by the inclusion of proprionic acid and the use of such materials as siccatives for paints, varnishes and inks, stabilizers in various plastics and additives for greases and lubricating oils as well as smoke-suppressing and anti-corrosion additives for fuel and fuel oils.

U.S. Pat. No. 3,723,152 to Alkaitis et al. describes basic cobalt salts of carboxylic acids and their use as drier compositions for oil vehicles.

Other patents such as U.S. Pat. No. 4,202,671 to Diehl et al. describe the use of organic magnesium compounds as fuel conditioners for the reduction of fuel requirements and emissions.

Increasing concern with pollution and the rising cost of hydrocarbon-based fuels, and lubricants has promoted continued interest in the use of transition metal compounds in such systems. It has been found, however, that such uses sometimes causes deleterious as well as beneficial effects. Among the deleterious effects are promotion of sediment and sludge, particularly in lubricants and fuel oils. Such deposits can interfere with storage and transport of the oil by promoting corrosion and interfering with pumps, meters and associated equipment.

Therefore, it is an object of the present invention to provide hydrocarbon-soluble compositions containing organic transition metal salts in combination with ashless dispersants, which provide an optimum balance between beneficial and deleterious effects. Other objects will be apparent to those of skill in the art upon reading this disclosure.

SUMMARY OF THE INVENTION

It has now been found that useful hydrocarbon-soluble compositions comprise (A) one or more transition metal salts of at least one organic acid; and (B) at least one hydrocarbon-soluble ashless dispersant.

Hydrocarbon systems such as lubricant and fuel compositions (such as distillate fuel compositions comprising a major amount of hydrocarbon fuel and a minor amount of the aforedescribed salt/dispersant compositions), as well as additive concentrate compositions, are also within the scope of the invention.

DETAILED DESCRIPTION OF THE INVENTION (A) The transition metal salts.

The transition metals in the organic salts of this invention are chosen from the group consisting of copper, scandium, titanium, vanadium, chromium, manganese, iron, cobalt, nickel and mixtures of two or more of these. Manganese salts and salts containing manganese in admixture with other metals are most commonly used. Often salts containing only manganese are used. Lead salts can also be used.

The organic acids used to make the transition metal salts used in this invention contain carbon atoms and include carboxylic acids, particularly those containing from 1 to 30 carbon atoms, sulfonic acids, particularly those containing an aromatic ring structure (e.g., benzene ring) substituted with one or more alkyl groups of 4 to about 22 carbon atoms, and phosphorus acids, containing within their structures one or more organic groups of 1 to about 30 or more carbon atoms.

Such carboxylic, sulfonic and phosphorus acids are well known to the art. The carboxylic acids can be mono- or polycarboxylic acids (if the latter, typically they are di- or tricarboxylic acids). Monocarboxylic acids include $C_{1-7}$ lower acids (acetic, propionic, etc.) and higher $C_{8+}$ acids (e.g., octanoic, decanoic, etc.) as well as the well known fatty acids of about 12–30 carbon atoms. The fatty acids are often mixtures or straight and branched chain acids containing, for example, from 5 to about 30% straight chain acids and about 70 to about 95% (mole) branched chain acids. Other commercially available fatty acid mixtures containing much higher proportions of straight chain acids are also useful. Mixtures produced from dimerization of unsaturated fatty acids can also be used.

Higher carboxylic acids include the well known dicarboxylic acids made by alkylating maleic anhydride or its derivatives. The products of such reactions are hydrocarbon substituted succinic acids, anhydrides, and the like. Lower molecular weight dicarboxylic acids, such as the polymethylene bridged acids (glutaric, adipic, and the like), can also be used to make the salts of this invention as well as the lower molecular weight substituted succinic acids such as tetrapropenyl succinic acid and its analogs of to about $C_{30}$ substituted acids.

Higher molecular weight substituted succinic anhydrides, acids, and analogs useful in making the salts of this invention have been described in a number of patents, particularly those dealing with acylated compounds useful as dispersants. Typical high molecular weight acids are those made by reacting a poly(isobutene) fraction having between 30 and 400 (usually 50–250) carbon atoms with maleic anhydride. Such materials are described in U.S. Pat. Nos. 3,172,892, 3,219,666 and 3,272,746 which are incorporated by reference herein for their disclosure of high molecular weight carboxylic acids. Other monocarboxylic acids of similar molecular weight can be made by alkylating acrylic acid and its analogs. Mixtures of such acids can also be used.

Useful salts can also be made from carbocylic carboxylic acid and even acidic hydroxy compounds such as alkylated phenols. Such materials are disclosed in U.S. Pat. No. 4,100,082, particularly columns 15–17, and these descriptions are incorporated by reference herein for such disclosure.

The '082 patent just identified also describes a number of sulfonic acids which are useful in making the salts of this invention. This patent, particularly columns 12–14, is incorporated by reference herein for its disclosure in this regard also.

Transition metal salts made from phosphorus acids are also useful in this invention. Such phosphorous acids have been disclosed in a number of U.S. patents and other literature. Exemplary of the former is U.S. Pat. No. 4,191,658 which discloses phosphorus acid salts of the formula

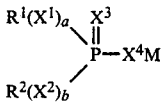

wherein M is a transition metal as described above; each $R^1$ and $R^2$ is hydrocarbon radical; each of $X^1$, $X^2$, $X^3$ and $X^4$ is oxygen or sulfur; and each of a and b is 0 or 1.

Typically, the organic acids used to make the salts of this invention are carboxylic acid, sulfonic acid, or mixtures thereof. A particularly useful group of such salts are those described in U.S. Pat. No. 4,162,986 to Alkaitis et al. which is hereby incorporated by reference for its disclosure of metallic organic compositions and, particularly, of transition metal salts of organic acids which are useful in the composition of the present invention.

It should be noted that the transition metal salts used in this invention are often overbased; that is, they contain more than sufficient metal to neutralize the acid present. In other words, they contain in excess of one equivalent of metal per equivalent of acid derived moiety. Such salts are known to the art. See, for example, the just cited U.S. Pat. No. 4,162,986 as well as the following U.S. Pat. Nos.: 3,827,979 to Piotrowski et al., 3,312,618 to LeSuer et al., 3,616,904 and 3,616,905 to Asseff et al., 2,595,790 to Norman et al., and 3,725,441 to Murphy et al.. These patents are hereby incorporated by reference for their disclosure of ovebased salts of organic acids.

(B) The ashless dispersants.

The ashless dispersants useful in the present invention are known to the art and are those dispersants commonly used in lubricants based on oils of lubricating viscosity and hydrocarbon fuels such as normally liquid hydrocarbon fuels. Ashless dispersants are those which leave little or no (metallic) residue or ash on combustion. Generally, this means that they are substantially metal free though they may contain, in addition to carbon, oxygen, hydrogen and, often, nitrogen elements such as phosphorus, sulfur, boron, etc.

Generally, the ashless dispersants of the present invention contain only C, H, O, and N. Occassionally, ester type dispersants (see below) can contain only C, H, and O. More complex ashless dispersants, while still metal free, may also contain other elements, such as sulfur, boron, phosphorus, and the like. Typically, however, the ashless dispersants used in this invention are of the nitrogen-containing or nitrogen-free ester type.

Many types of ashless dispersants are known; see, for example, the descriptions in "Lubricant Additives—Recent Developments" and the earlier "Lubricant Additives", both by M. W. Ranney, published by Noyes Data Corporation, Park Ridge, N.J., 1978 and 1973, respectively. Both these references and U.S. Pat. No. 4,136,043 are hereby incorporated by reference for their disclosure of ashless dispersants.

Among the more commonly available and, therefore, useful hydrocarbon-soluble ashless dispersants are:

(1) Acylated nitrogen-containing dispersants such as those described in U.S. Pat. No. 4,100,082 which is incorporated by reference for its disclosure, particularly those at columns 18–20.

These dispersants are made by reaction of an acylating agent (e.g., carboxylic acid or anhydride) with an amino compound such as an amine, polyamine, or other compound containing an —NH— group. Typical acylating agents include the substituted succinic acids described above and in the '082 patent. Other useful acylating agents have been described in detail in many other patents, such as U.S. Pat. No. 4,234,435 which describes in detail both acylating agents and amino-containing and non-amino-containing compounds which can be used to prepare ashless dispersants. This patent is also incorporated by reference for its disclosure in this regard.

The acylated ashless dispersants useful in the present invention can be of either the high or low molecular weight type. In addition to portions from amino compounds, they may also incorporate portions from mono- and poly-alcohols, including amino hydroxy compound groups such as the well known amino alcohols. Typical ashless dispersants include those made from alkylene polyamines having 2 to 7 amino groups and 1 to 6 alkylene groups, each containing 2 to 4 carbon atoms. The commercially available ethylene polyamines are useful reagents in this regard.

Lower molecular weight acylated nitrogen-containing compounds are also useful as dispersants in the compositions of this invention. Such compounds are made from the aforedescribed amino compounds and mono- and dicarboxylic acid acylating agents containing about 12 to about 20 carbon atoms. Such dispersants often contain imidazoline groups and are known to the art; see, for example, U.S. Pat. Nos. 3,405,064 and 3,240,575 which are incorporated by reference herein for their disclosure in this regard.

High molecular weight acylated nitrogen-containing ashless dispersants wherein an amino and alcohol compound (or amino-alcohol) both are acylated are also known and useful in the compositions of this invention; these are described in U.S. Pat. No. 4,136,043 which is incorporated by reference herein for its disclosure of such dispersants.

(2) High molecular weight nitrogen-free esters.

These esters, as indicated above, are made by reacting the aforedescribed acylating agents (e.g., poly(isobutene)) succinic anhydride with polyols and monoalcohols and are well known; see, for example, U.S. Pat. No. 3,522,179, which is incorporated herein by reference for its disclosure of such esters.

(3) Hydrocarbyl substituted amines.

Hydrocarbyl substituted amines useful as ashless dispersants are known in the art; see, for example, U.S. Pat. Nos. 3,275,554, 3,438,757, 3,454,555, and 3,565,804. A discussion of such materials also appears in the aforementioned '082 patent. All these patents are incorporated by reference herein for their disclosure of suitable hydrocarbyl amines for use as ashless dispersants in the present invention.

(4) Nitrogen-containing condensates of phenols, aldehydes and amino compounds.

Condensates made from reacting a phenol, aldehyde (such as formaldehyde) and amino compounds (such as those described above) are useful as ashless dispersants in the compositions of this invention. These materials are often generically known as Mannich condensates. Generally, they are made from reacting a hydrocarbon substituted phenol (e.g., an alkylated phenol having an alkyl group of about 34–400 carbon atoms), formaldehyde and an amino or polyamino compound having at least one —NH— group. A number of such materials are known to the art; see, for example, the aforementioned '082 patent, particularly columns 21–22, and the references cited therein which is incorporated by reference herein for its disclosure of Mannich condensates and methods for making them.

The hydrocarbon-soluble compositions of this invention are made by combining (A) one or more of the aforedescribed transition metal salts of organic acids with (B) at least one of the aforedescribed hydrocarbon-soluble ashless dispersants. It should be noted that "hydrocarbon soluble" in describing this invention means that the material in question has a solubility at 25° C. of at least 0.001 parts by weight in the hydrocarbon system in which it is to function. The combination of the materials (A) and (B) can be effected in any convenient manner. Usually, it is advantageous to avoid combining the salt and the dispersant directly since precipitation problems can thus be avoided. Therefore, it is common to combine either the dispersant or the salt with an inert, solvent diluent and then combine this material with the other and/or auxiliary agents. The solvent-/diluents used in the composition of this invention are usually hydrocarbyl in nature although they may contain small amounts of other hetero elements and are often highly aromatic to promote solubility. Auxiliary agents used in the compositions of this invention include dyes, anti-oxidants, metal deactivators, and, particularly, demulsifying agents which inhibit the tendency of the dispersant and/or the salt to promote emulsion formations in the vehicles it is used to treat, such as fuel oils, lubricants and the like. Many such demulsifying agents are known; see, for example, Encyclopedia of Chemical Technology—Kirk-Othmer, Volume 8, pages 151 et seq. and Volume 19, pages 507 et seq. (1965). Typical demulsifying agents are surface active agents containing hydrophilic and lipophilic portions in the molecule. Such agents are often made by reacting a hydroxy compound, such as a phenol or alcohol, with materials such as ethylene oxide and propylene oxide and their mixtures in various proportions.

As indicated above, the compositions of this invention are used to treat lubricants based on lubricating oils of lubricating viscosity and hydrocarbon fuels. The lubricating oils are typically hydrocarbon in nature although they may contain non-hydrocarbyl portions, such as synthetic ester, ether, and similar oils.

The fuels treated with the compositions of this invention include both solid and normally liquid fuels. Among the solid fuels are coal, shale, peat, wood, organic refuse, charcoal and the like. Liquid fuels encompass the lighter petroleum fractions such as gasoline, kerosene, and the like, as well as other fractions such as middle distillate fuel oils. Typical middle distillate fuel oils which can be treated with the compositions in this invention include No. 1, 2, and 4 fuel oils as define by ANSI/ASTM Standard D-396-79 and other such materials. Combinations of such fuel oils with straight run, vacuum run, and other specially treated residual oils can also be advantageously treated with the combinations of the present invention.

The concentration of the compositions of this invention in the treated lubricant or oil compositions is such that the treated lubricant or oil compositions contain about 1–500, preferably 5–350 ppm (by weight) transition metal* and about 5–1000, preferably 10–800 ppm (by weight) ashless dispersant. In fuel oils, particularly, the composition is used to produce a transition metal concentration at about 10–200 ppm (by weight) and ashless dispersant concentration of about 15–450 ppm (by weight).

*The concentration of salt is expressed in terms of metal alone.

EXAMPLES

EXAMPLE 1

A known ashless acylated nitrogen-containing dispersant is prepared by reacting a mixture of poly(isobutene) substituted succinic anhydride acylating agent (having a substituent with an Mn equal to about 1,000) with a commercial mixture of ethylene polyamines averaging in composition triethylene tetra-amine. The reaction is carried out in aromatic solent/diluent and the proportion of acid to polyamine, by weight, is approximately 100 to 9; water and other low-boiling products and impurities are removed by heating to give the desired ashless dispersant having a nitrogen content of about 2% (by weight).

EXAMPLE 2

A hydrocarbon-soluble composition is prepared by combining by weight the following: an overbased manganese carboxylate* (containing 40% by weight Mn)—10.82 parts, the ashless dispersant of Example 1–14.43 parts, a first demulsifier**—0.18 parts, a second demulsifier (3)—0.14 parts, and aromatic solvent (4)—74.43 parts. *Sold by the Mooney Chemical Company as Mooney 910. **An Ethoxylated/Propylated Hydroxy Compound available as TOLAD 285 from The Tretolite Division of Petrolite Corporation, St. Louis, Missouri. (3) An Ethoxylated Propoxylated Pentaerythritol available as NALCO 5RD-648 from the Nalco Chemical Company of Houston, Texas. (4) HI-SOL Aromatic Solvent having a Kauri Gum-Butanol Value of 95. The above combination is made by using the aromatic solvent in such a way as to avoid direct combination of the concentrated carboxylate and ashless dispersant. The combination has a specific gravity at 15.6° of 0.94, a pour point of −57° C., and a manganese content of 4.3–4.6 percent by weight.

EXAMPLE 3

The composition of Example 2 was used to treat a typical commercially available No. 2 middle distillate fuel oil. The treatment level is 1 part composition to 4600 parts by weight of fuel oil. This treatment level is equivalent to 10.7 parts per million manganese per part of fuel. The treated fuel was used to operate a commercial boiler and compared with use of untreated fuel in the same boiler under comparable conditions. It was found that use of the compositions of this invention in the fuel, as described above, produced a 1.7 percent efficiency improvement as reflected by reduced fuel comsumption.

What is claimed is:

1. A fuel composition comprising:

a major amount of a solid fuel or middle distillate fuel, and a minor fuel efficiency improving amount of a mixture of (A) one or more overbased transition metal salts of at least one organic acid, said organic acid being selected from the group consisting of carboxylic acid, phosphoric acid, sulfonic acid and mixtures thereof; and (B) at least one hydrocarbon-soluble ashless dispersant.

2. A composition as claimed in claim 1 wherein the organic acid contains at least about 7 carbon atoms.

3. A composition as claimed in claim 1 wherein the metal is chosen from the group consisting of copper, scandium, titanium, vanadium, chromium, manganese, iron, cobalt, nickel, lead and mixtures of two or more of these.

4. A composition as claimed in claim 1 wherein the acid is a carboxylic acid, sulfonic acid or mixture thereof.

5. A composition as claimed in claim 1 wherein the metal is manganese.

6. A composition as claimed in claim 1 wherein the dispersant (B) is a nitrogen-containing dispersant, a nitrogen-free ester dispersant or a mixture thereof.

7. A fuel composition comprising:

a major amount of a solid fuel or middle distillate fuel, and a minor fuel efficiency improving amount of a mixture of (A) one or more overbased transition metal salts of at least one organic acid, said organic acid being selected from the group consisting of carboxylic acid, phosphoric acid, sulfonic acid and mixtures thereof;

(B) at least one hydrocarbon-soluble ashless dispersant;

(C) at least one demulsifier; and (D) substantially inert solvent-diluent.

8. A composition as claimed in claim 7 where (A) is an overbased manganese salt of a carboxylic acid, a sulfonic acid or mixxture thereof; and (B) is an acylated nitrogen-containing dispersant.

9. A composition as claimed in claim 1 wherein the metal is copper.

10. The composition of any one of claims to 7 wherein the transition metal content of said composition is about 1–500 ppm.

11. The composition of any one of claims 1, to 7 wherein the transition metal content of said composition is about 10–200 ppm.

* * * * *